US005567532A

United States Patent [19]

Peker et al.

[11] Patent Number: 5,567,532

[45] Date of Patent: Oct. 22, 1996

[54] AMORPHOUS METAL/DIAMOND COMPOSITE MATERIAL

[75] Inventors: Atakan Peker; William L. Johnson, both of Pasadena, Calif.; Robert Schafer, Worthington, Ohio; David M. Scruggs, Oceanside, Calif.

[73] Assignee: Amorphous Alloys Corp., Laguna Niguel, Calif.

[21] Appl. No.: 284,153

[22] Filed: Aug. 1, 1994

[51] Int. Cl.[6] ..... C22C 9/00

[52] U.S. Cl. ..... 428/457; 428/323; 428/408; 428/697; 428/699; 420/417; 420/422

[58] Field of Search ..... 428/408, 457, 428/699, 697, 323; 420/417, 422

[56] References Cited

U.S. PATENT DOCUMENTS

| | | | |
|---|---|---|---|
| 4,268,564 | 5/1981 | Narasimhan | 428/143 |
| 4,960,643 | 10/1990 | Lemelson | 428/408 |
| 5,288,344 | 2/1994 | Peker et al. | 148/403 |
| 5,380,349 | 1/1995 | Taniguchi et al. | 65/286 |

OTHER PUBLICATIONS

GE Promotional Literature, "A World of Superabrasives Experience At Your Service" 4 pp., date unknown.

GE Promotional Literature, "GE Superabrasives–The Metal Bond System", 1 p., date unknown.

GE Promotional Literature, "GE Superabrasives–the Resin Bond System", 1 p., date unknown.

GE Promotional Literature, "GE Superabrasives–Micron Powders", 1 p., date unknown.

GE Promotional Literature, "The MBS 700 Series Product Line", 2 pp., Oct 1993.

GE Promotional Literature, "The MBS 900 Series Product Line", 2 pp., 1992.

*Primary Examiner*—Archene Turner
*Attorney, Agent, or Firm*—Gregory Garmong

[57] ABSTRACT

A diamond-containing metal-matrix composite material is formed by dispersing pieces of diamond throughout a melt of a bulk-solidifying amorphous metal and solidifying the mixture. The mixture may then be remelted and resolidified at a rate sufficiently high that the metal matrix retains an amorphous structure upon cooling. The metal preferably has a composition of about that of a eutectic composition, and most preferably has a composition, in atomic percent, of from about 45 to about 67 percent total of zirconium plus titanium, from about 10 to about 35 percent beryllium, and from about 10 to about 98 percent total of copper plus nickel. The diamond is preferably low-grade or artificial diamond.

13 Claims, 2 Drawing Sheets

AMORPHOUS METAL/DIAMOND COMPOSITE MATERIAL

BACKGROUND OF THE INVENTION

This invention relates to a composite material having diamonds bonded into an amorphous metal matrix.

Hard, abrasive materials such as certain carbides, borides, and nitrides are widely used to cut other, softer materials such as metals. Large single pieces of these hard, abrasive materials are too brittle and too expensive for many cutting-tool applications. A bonded-tool technology has developed over the years for using smaller pieces of such materials in cutting tools. In this approach, small particles of the hard, abrasive material are bonded at elevated temperatures into a matrix of a metal such as a nickel or cobalt alloy by liquid phase sintering. This process requires considerable exposure time of the components at elevated temperatures. Upon cooling, the resulting composite material has the particles of the hard, abrasive material dispersed throughout the metal matrix. The metal matrix bonds the particles together and also imparts fracture toughness and thermal conductivity to the article. As one example of this type of material, tungsten carbide/cobalt alloy cutting tools are widely used commercially.

When such a composite material is used as a cutting tool, the surface regions of the metal matrix quickly wear away to expose the pieces of the hard, abrasive material. This exposed region acts as the cutting instrument, inasmuch as it is hard, abrasive, durable, and unlikely to wear away during the cutting operation. However, the underlying metal matrix which bonds the hard, abrasive material can wear away or crack with extended use.

Diamond is the hardest known substance, and is therefore desirably used in cutting tools. Diamond/metal-matrix composite cutting tools: have been made. However, in most cases these cutting tools are expensive because relatively expensive, high-purity natural diamond is used. Lower grade natural or artificial diamond tends to chemically degrade by graphitization in the high-temperature sintering process by which the diamond particles are bonded to the metal matrix. Additionally, in many instances the diamond/metal-matrix composite materials have yielded less than the expected cutting performance because the metal matrix is not sufficiently resistant to abrasion and fracture. Consequently, the metal matrix wears away and/or fractures relatively quickly, resulting in the loss of the cutting edge.

There is a need for an improved approach by which low-grade artificial or natural diamonds can be used in cutting implements. The present invention fulfills this need, and further provides related advantages.

SUMMARY OF THE INVENTION

This invention provides a metal-matrix composite material having diamonds bonded together by an amorphous-metal matrix, and a method for preparing the composite material. A wide range of types of diamond can be used, including low-grade natural or artificial diamonds that cannot be readily used in other types of bonded cutting tools. In a preferred approach, a bulk-solidifying amorphous material is employed, permitting the preparation of (large, tool-sized pieces of the composite material rather than thin ribbons.

In accordance with the invention, a method of forming a diamond-containing metal-matrix composite material comprises the steps of providing at least one piece of diamond and providing a metal having a capability of retaining the amorphous state when cooled from its melt at a critical cooling rate of no more than about 500° C. per second. The metal is melted and the at least one piece of diamond is dispersed throughout the melt to form a mixture. The mixture is solidified at a cooling rate no less than the critical cooling rate.

The diamond can be any grade of diamond, but is preferably low-grade natural or artificial diamond that is relatively inexpensive and not usable in other types of bonded cutting tools. Such diamond has the hardness of high-grade diamond, but contains impurities that cause it to chemically degrade by graphitization in conventional bonding approaches. The metal-matrix material is a bulk-solidifying amorphous material in which the amorphous state can be retained in cooling from the melt at a rate of no greater than about 500° C. per second.

A preferred such metal-matrix material has a composition near a eutectic composition, such as a deep eutectic composition with a eutectic temperature on the order of 660° C. This material has a composition, in atom percent, of from about 45 to about 67 percent total of zirconium plus titanium, from about 10 to about 35 percent beryllium, and from about 10 to about 38 percent total of copper plus nickel, plus incidental impurities adding to a total of 100 atom percent. Certain substitutions can be made in this composition, as will be discussed subsequently.

In one embodiment, the mixture of molten metal and diamond particles is cooled to solidify the metal, without regard to the rate of cooling. The mixture is thereafter reheated to remelt the metal at a higher temperature than the initial melting temperature, held for a few minutes at that temperature, and resolidified at a rate sufficiently high to ensure retention of the amorphous state. This procedure ensures an amorphous state in the metal matrix.

In the composite material of the invention, the amorphous-metal matrix bonds the diamond particles together. The diamond particles are not degraded during fabrication and therefore can attain their full potential in a cutting tool. Moreover, the amorphous matrix itself is hard so that it does not rapidly wear away during service, yet is reasonably ductile and fracture resistant. The composite material is therefore operable as a cutting tool that is hard yet resistant to failure. The amorphous material is also highly corrosion resistant, because it has no internal grain boundaries to serve as preferential sites for the initiation of corrosion. Corrosion resistance is desirable, because cutting tools are often used with coolants and lubricants that may cause corrosion.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
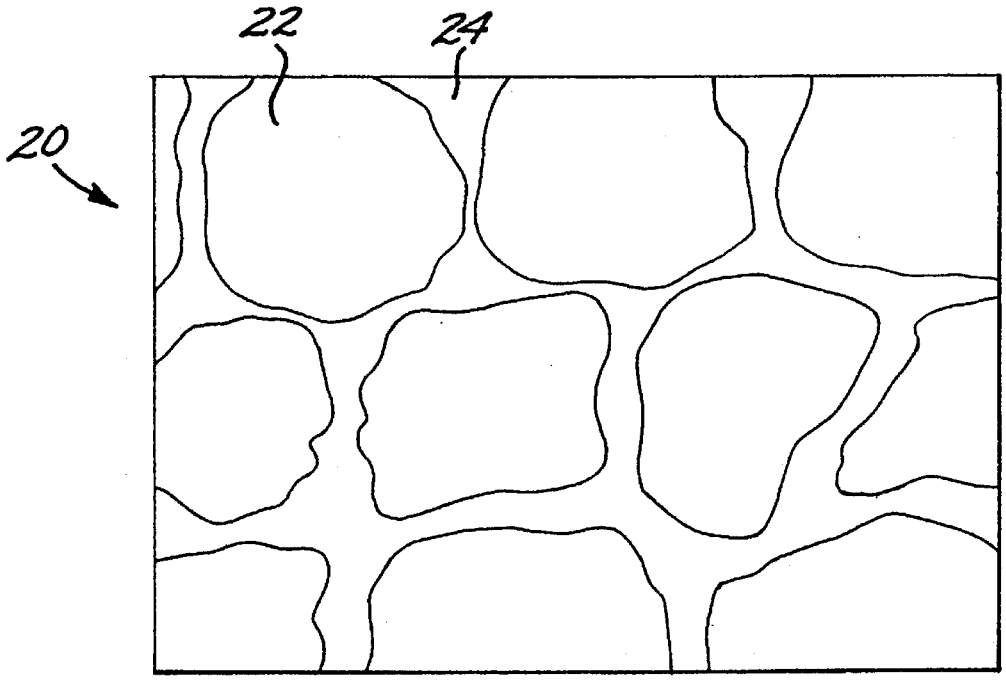
FIG. 1 is a drawing of the microstructure of the material of the invention.

FIG. 1 illustrates an idealized microstructure of a composite material 90 made by the present approach. The composite material 20 is a mixture of two phases, a diamond particle phase 22 and a metal-matrix phase 24 that surrounds and bonds the diamond phase In an embodiment of the invention wherein a uniform array of diamond particle phase within the metal-matrix phase is attained, the diamond phase 22 desirably occupies from about 50 to about 90 volume percent of the total of the diamond phase and the metal-matrix phase, although phase percentages outside this range are operable. If the diamond phase is present in a smaller volume percent, it becomes progressively more difficult, as the amount of diamond phase is reduced, to prepare a uniform dispersion of the diamond phase within the metal-matrix phase using the preferred melt-fabrication technique. If the diamond phase is present in a higher volume percent, it is difficult to form a homogeneous mixture with matrix phase surrounding and wetting the diamond particles. Additionally, the composite material will have an unacceptably low fracture resistance. In a most preferred form of this embodiment, the diamond phase occupies from about 70 to about 85 volume percent of the total material. This embodiment is desirably used for cutting tools and the like.

In another embodiment, a smaller volume percent of diamond is present in a composite material in which the diamond phase is concentrated at the surface of the material. It has been observed that, for low volume percentages of diamond present in the composite material, the diamond particles preferentially segregate to the surface of the composite material as the matrix phase is cooled and becomes increasingly viscous. This form of the invention can utilize much smaller volume percentages of diamond in the composite material, and is particularly valuable when the final material is to be used for applications such as surface finishing or polishing.

Figure 2:
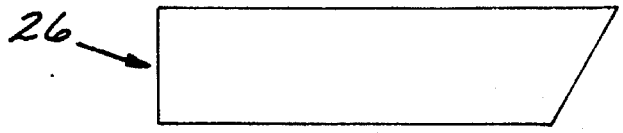
FIG. 2 is an elevational view of a first type of cutting tool made using the material of the invention.
Figure 3:
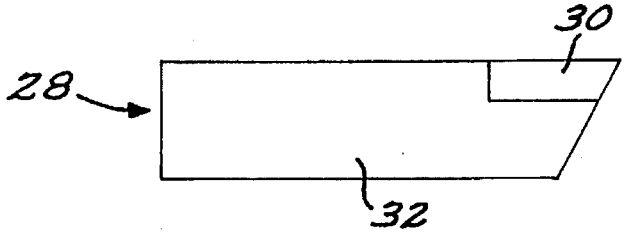
FIG. 3 is an elevational view of a second type of cutting tool made using the material of the invention.

FIGS. 2 and 3 illustrate cutting tools made of the material of the invention, as shown in FIG. 1. These depicted cutting tools are presented as illustrations, and other geometries can be prepared, such as drills, milling cutters, cutting blades, and cutting wheels, for example. The cutting tool 26 of FIG. 2 is made entirely of the composite material 20. Alternatively, the cutting tool 28 of FIG. 3 has only a cutting insert 30 made of the composite material 20. The cutting insert 30 is bonded or affixed to a tool support 92 made of steel or other inexpensive material.

Figure 4:
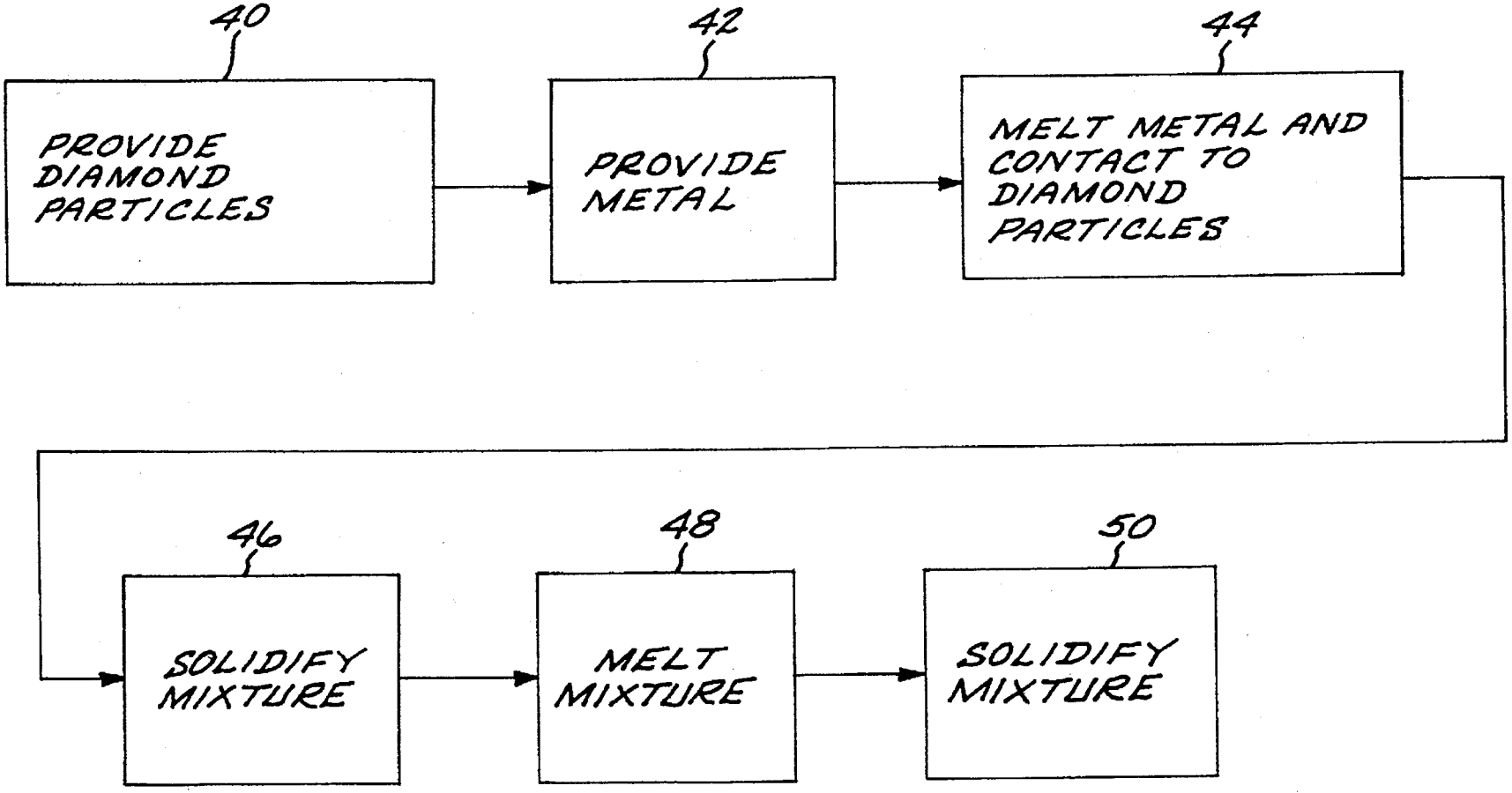
FIG. 4 is a flow diagram for a preferred approach to preparing the material of FIG. 1.

FIG. 4 illustrates a method for fabricating pieces of the composite material 20 and/or articles made of the composite material 20. Diamond particles are first provided, numeral 40. The diamond particles are preferably of a size of from about 20 to about 160 mesh for use in cutting, drilling, grinding, and comparable applications. The diamond particles are preferably smaller than this range for use in polishing applications. The diamond particles are typically not perfectly regular in shape, but are generally equiaxed and irregularly shaped, as shown in FIG. 1. The indicated dimension is an approximate maximum dimension of the particles. Most preferably, the diamond particles are from about 20 to about 80 mesh in size for cutting applications. Blocky diamonds are most preferred for cutting applications involving impact forces. Other shapes of diamond particles are acceptable, however.

Any type of diamond is acceptable for use with the invention. Diamonds range in quality from gem quality to industrial quality and to very low-grade quality that may not be suitable for many industrial applications such as cutting tools. Diamonds can be either natural or artificial. The pertinent indicators of quality in respect to the present invention are chemical composition, inclusion content, and crystal perfection, not physical appearance (although physical appearance may be related to these factors). All diamonds are made primarily of carbon arranged in the diamond-cubic crystal structure. However, artificial and natural diamonds typically have various types and amounts of impurities present. Both natural and artificial diamonds often exhibit a form containing grain boundaries and other imperfections, primarily impurity inclusions.

These factors affect the usability of diamonds in conventional bonded cutting tool materials. Low-grade diamonds that have large amounts of impurities and substantial densities of imperfections are not suitable for use in conventional bonded cutting tools because they chemically and/or physically degrade during the high temperature exposure required in the bonding operation. As used herein, "low-grade diamond" is defined as diamond which experiences damage, for example in the form of a loss of toughness and wear resistance, when exposed for 10 minutes or more at a temperature of 800° C. or more.

The use of low-grade diamonds is preferred in the present approach. Low-grade diamonds have properties that may be slightly inferior to higher grade diamonds, but their price is significantly lower because of their lesser desirability for either gem or industrial applications. A major virtue of the present invention is the ability to use such low-grade diamonds in a bonded material suitable for use in cutting tools.

The matrix material is provided, numeral 42. The matrix material is a metal alloy that can be cooled from the melt to retain the amorphous form in the solid state, termed herein a "bulk solidifying amorphous metal". Such metals can be cooled from the melt at relatively low cooling rates, on the order of 500° C. per second or less, yet retain an amorphous structure.

This ability to retain an amorphous structure even with a relatively slow cooling rate is to be contrasted with the behavior of other types of amorphous metals that require cooling rates of at least about $10^{4\circ}$–$10^{6\circ}$ C. per second from the melt to retain the amorphous structure upon cooling. Such metals can only be fabricated in amorphous form as thin ribbons or particles. The preparation of thin strips of such prior amorphous metals with diamonds embedded in the top surface of the strip has been suggested previously, see U.S. Pat. No. 4,268,564. Such a form has limited usefulness in the preparation of cutting tools and the like, both because of the fabrication difficulties and also because the diamonds are not dispersed throughout the volume of the article.

A preferred type of bulk-solidifying amorphous alloy has a composition of about that of a deep eutectic composition. Such a deep eutectic composition has a relatively low melting point and a steep liquidus. The composition of the bulk-solidifying amorphous alloy should therefore be selected such that the liquidus temperature of the amorphous alloy is no more than about 50° C. higher than the eutectic temperature, so as not to lose the advantages of the low eutectic melting point. Because of this low melting point, the melt-fabrication processing of the invention can be accomplished at a sufficiently low temperature that degradation of the diamond particles is minimized.

A preferred type of bulk-solidifying amorphous alloy has a composition near a eutectic composition, such as a deep eutectic composition with a eutectic temperature on the order of 660° C. This material has a composition, in atom percent, of from about 45 to about 67 percent total of zirconium plus titanium, from about 10 to about 35 percent beryllium, and from about 10 to about 38 percent total of copper plus nickel. A substantial amount of hafnium can be substituted for some of the zirconium and titanium, aluminum can be substituted for the beryllium in an amount up to about half of the beryllium present, and up to a few percent of iron, chromium, molybdenum, or cobalt can be substituted for some of the copper and nickel. A most preferred such metal-matrix material has a composition, in atomic percent, of about 41.2 percent zirconium, 13.8 percent titanium, 10 percent nickel, 12.5 percent copper, and 22.5 percent beryllium. This bulk-solidifying alloy is known and is described in U.S. Pat. No. 5,288,344, whose disclosure is incorporated by reference.

The bulk-solidifying alloy is melted, and the diamond particles are contacted to the melt, numeral 44. In this context. "contacted" can mean either that the diamond particles are dispersed within the melt or the melt is infiltrated into a mass of the diamond particles. When the volume percent of diamond particles is relatively smaller compared to the volume percent of metal, the diamonds can be stirred into the melt. When the volume percent of diamond particles is relatively larger compared to the volume percent of metal, the melt is allowed to flow into, or is forced into, the mass of diamond particles by infiltration.

The most preferred bulk-solidifying alloy discussed in the second preceding paragraph has a melting point of about 670° C. It is heated somewhat above that temperature, preferably to a temperature of from about 700° C. to about 850° C., most preferably to a temperature of about 750° C., in an atmosphere of pure argon. The diamond particles are added and dispersed within the melt by stirring. The mixture of molten metal and diamond particles, which are not melted, is retained at the melting temperature for a short time of about one minute. The melt is then allowed to cool, causing the molten metal to solidify, numeral 46.

The mixture may be cooled at a sufficiently high solidification rate to cause the molten metal to remain in the amorphous state, but not greater than about 500° C. per second, to produce a composite material. However, a degree of crystallization is sometimes noted around the diamond particles, which are thought to induce such crystallization.

Alternatively and preferably, the mixture may be cooled at any cooling rate in step 46, without regard to whether the structure of the solid metal is amorphous. The solidified mixture is thereafter heated to remelt the mixture, numeral 48. The mixture, now with the metallic alloy molten, is heated to a higher temperature than used for the prior mixing. In the case of the preferred composition, the mixture is heated to a temperature of about 800°–900° C., most preferably about 850° C., for a time of up to about two minutes.

The mixture is thereafter solidified, numeral 50, by cooling it at a cooling rate sufficiently high that the amorphous state of the metallic alloy is retained, but in no event at a rate greater than about 500° C. per second. If higher cooling rates are required, it is difficult to obtain sufficiently thick pieces for most applications. When the method is practiced properly, the resulting structure is like that depicted in FIG. 1, with diamond particles 22 dispersed within a substantially completely amorphous metal-matrix phase 24.

In a variation of the approach Just described, the solidification step 45 is omitted. The melt is heated to a higher temperature in step 48 directly from the melting and dispersing temperature used in step 44.

In another variation, the steps 46 and 48 are omitted, but the melting temperature of step 44 is somewhat higher than used in the prior approaches.

The reason that the last two treatments, wherein the melt is heated to a higher temperature briefly after the diamond p articles are dispersed into the melt, produce a superior microstructure is not known with certainty. Without being bound by this possible explanation, it is believed that a chemical reaction product is formed between the diamond particles and the molten metal during step 48. The chemical reaction product prevents the diamond from inducing local crystallization of the metallic phase during solidification step 50. For this reason, it is expected that other techniques for preventing the diamond from inducing local crystallization, such as a coating deposited upon the diamond in step 40, would be equivalent to reheating. The operability of the invention is not dependent upon this possible explanation, however.

To achieve the benefits of the higher temperature treatment, the mixture of molten metal and diamonds should be heated to a temperature of at least about 100° C. above the liquidus temperature of the melt for a time of up to about two minutes.

The following examples illustrate aspects of the invention, but should not be taken as limiting the invention in any respect.

EXAMPLE 1 quantity of General Electric MBG-T artificial diamond particulate material, exhibiting a light green color and having a size of 100–120 mesh, was infiltrated with molten metal of the preferred composition discussed previously. Infiltration was accomplished in an atmosphere of clean, gettered argon at a temperature of about 750° C. The metal wetted the diamond particles well, and the resulting mass was cooled to ambient temperature at a rate of from about 10° C. to about 120° C. per second. The time of contact between the diamond and the molten metal at the infiltration temperature was less than one minute. Upon metallographic inspection, the metallic matrix of a specimen of the diamond/metal composite material was seen to be primarily amorphous, but to have some crystallization evident adjacent to the diamond particles. The remainder of the material was reheated to a temperature of about 900° C. for about two minutes and cooled to ambient temperature at a rate of from about 10° C. to about 120° C. per second. The matrix was again inspected and found to be entirely amorphous, with no crystalline material present.

EXAMPLE 2

A quantity of General Electric RVG artificial diamond particulate material, exhibiting a black color and having a size of 100–120 mesh, was infiltrated with molten metal of the preferred composition discussed previously. Infiltration was accomplished in an atmosphere of clean, gettered argon at a temperature of about 800° C. The metal wetted the diamond particles well, and the resulting mass was cooled to ambient temperature at a rate of from about 10° C. to about 120° C. per second. The time of contact between the diamond and the molten metal at the infiltration temperature was about two minutes. Metallographic inspection revealed that the metal matrix was entirely amorphous.

The present invention provides an approach for preparing a hard, abrasive composite material useful as a cutting tool or as a wear-resistant structure. The diamonds embedded in the matrix provide the primary cutting and wear-resistance function. The amorphous matrix effectively bonds the diamonds, and is itself a relatively hard, tough, abrasive material. Thus, the matrix does not readily wear away or crack during service, resulting in pull-out of the diamonds from the wearing surface. The amorphous matrix material and the composite structure itself impart fracture resistance to the composite material, another important attribute for cutting tools, abrasion-resistant surfaces, and similar articles.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A diamond-containing metal-matrix composite material prepared by the process comprising the steps of:

providing at least one piece of diamond;

providing a metal having a capability of retaining an amorphous state when cooled from its melt at a critical cooling rate of no more than about 500° C. per second;

melting the metal and dispersing at least one piece of diamond throughout the melt to form a mixture; and solidifying the mixture at a cooling rate.

2. A diamond-containing metal-matrix composite material prepared by the process comprising the steps of:

providing a plurality of pieces of diamond;

providing a metal capable of retaining an amorphous state when cooled from its melt and which has a composition of about that of a eutectic composition;

melting the metal and dispersing the pieces of diamond throughout the melt to form a mixture;

solidifying the mixture;

remelting the mixture;

resolidifying the mixture at a cooling rate sufficiently high to cause the metal to remain in the amorphous state after cooling, at a rate no higher than 500° C. per second.

3. A diamond-containing metal-matrix composite material, comprising a mass of a bulk-solidifying amorphous metal which retains an amorphous structure when cooled from the melt at a rate of about 500° C. or less; and a plurality of diamonds dispersed throughout the mass of amorphous metal.

4. The composite material of claim 3, wherein the amorphous metal has a composition, in atom percent, of from about 45 to about 67 percent total of zirconium plus titanium, from about 10 to about 35 percent beryllium, and from about 10 to about 38 percent total of copper plus nickel.

5. The composite material of claim 4, wherein there is a substitution selected from the group consisting of hafnium for some of the zirconium plus titanium, aluminum for some of the beryllium, and an element selected from the group consisting of iron, chromium, molybdenum, and cobalt for some of the copper plus nickel.

6. The composite material of claim 3, wherein the bulk-solidifying amorphous metal has a composition of about that of a eutectic composition.

7. The composite material of claim 3, wherein the plurality of diamonds have a size of from about 20 mesh to about 160 mesh.

8. The composite material of claim 3, wherein the plurality of diamonds are artificial diamonds.

9. The composite material of claim 3, wherein plurality of diamonds are low-grade diamond material.

10. The composite material of claim 3, wherein the plurality of diamonds occupy from about 50 to about 90 volume percent of the total of diamond and amorphous metal.

11. The composite material of claim 3, wherein the plurality of diamonds occupy from about 70 to about 85 volume percent of the total of diamond and amorphous metal.

12. The composite material of claim 3, wherein the amorphous metal has a composition, in atomic percent, of about 41.2 percent zirconium, about 13.8 percent titanium, about 10 percent nickel, about 12.5 percent copper, and about 225 percent beryllium.

13. The composite material of claim 3, wherein the plurality of diamonds are dispensed uniformly in the bulk-solidifying amorphous metal.

* * * * *